US008376716B2

(12) United States Patent
Anderson et al.

(10) Patent No.: US 8,376,716 B2
(45) Date of Patent: Feb. 19, 2013

(54) MULTI-PUMP SEQUENCING

(75) Inventors: Thomas M. Anderson, Naples, FL (US); Charles Wanstrom, Maplewood, MN (US); Franz Tillman, Lagrangeville, NY (US)

(73) Assignee: Schwing Bioset, Inc., Somerset, WI (US)

( * ) Notice: Subject to any disclaimer, the term of this patent is extended or adjusted under 35 U.S.C. 154(b) by 797 days.

(21) Appl. No.: 12/384,971

(22) Filed: Apr. 10, 2009

(65) Prior Publication Data

US 2010/0260615 A1 Oct. 14, 2010

(51) Int. Cl.
*F04B 49/20* (2006.01)

(52) U.S. Cl. ..... 417/46; 417/375; 417/53

(58) Field of Classification Search ..... 417/46, 417/53, 342, 344, 399, 403, 902, 3, 426, 417/427

See application file for complete search history.

(56) References Cited

U.S. PATENT DOCUMENTS

| | | | | |
|---|---|---|---|---|
| 4,437,817 | A | | 3/1984 | Metzelder |
| 5,330,327 | A | | 7/1994 | Anderson |
| 5,507,624 | A | | 4/1996 | Fehn |
| RE35,473 | E | | 3/1997 | Oakley et al. |
| 5,634,779 | A | * | 6/1997 | Eysymontt ..... 417/342 |
| 5,839,883 | A | | 11/1998 | Schmidt et al. |

* cited by examiner

*Primary Examiner* — Anh T. Mai
*Assistant Examiner* — Brenitra M Lee
(74) *Attorney, Agent, or Firm* — Kinney & Lange, P.A.

(57) ABSTRACT

A pump system for pumping a viscous material that includes N positive displacement pumps, where N is an integer greater than two, and a hydraulic drive. Each pump has an inlet and an outlet therefrom, and a pair of cylinders each with a piston movable in a reciprocating stroke cycle therein. The hydraulic drive is connected to the N positive displacement pumps to reciprocate the pistons within the cylinders. The stroke cycle includes a discharging stroke and a filling stroke. The discharging stroke and the filling stroke of the N positive displacement pumps are staggered from one another by 1/N stroke positions such that no two pumps have pistons in the same stroke position at the same time.

25 Claims, 7 Drawing Sheets

MULTI-PUMP SEQUENCING

BACKGROUND

The present invention relates to a positive displacement viscous material pump assembly, and more particularly, to a viscous material pump assembly with three or more interconnected pumps.

In recent years, viscous material pumps (also referred to as sludge pumps or high solids material pumps) have found increasing use for conveying viscous material through a pipeline in municipal and industrial applications. Examples of viscous materials that can be conveyed with viscous material pumps includes thermally conditioned viscous material from clarifiers, filter cakes in food apparatus, flotation tailings in various mining operations, and bentonite-concrete mixtures for support extrusions.

In a typical viscous materials handling system, a feed system delivers material to a positive displacement pump which pumps the material to a disposal system. The feed system may include a belt press, an auger, a centrifuge or other devices for drying the material and delivering the material to the positive displacement pump. For example, in a viscous material application, the feed system may include a centrifuge or hopper, a screw feeder and a transition housing. The centrifuge dewaters and stores the viscous material prior to pumping. Once the viscous material has been dewatered, the centrifuge delivers the material to the screw feeder. The screw feeder, in turn, forces the viscous material through the transition housing into an inlet of the positive displacement pump.

The positive displacement pump can assume a variety of forms, but typically includes an inlet and one or more material cylinders which pump material to an outlet. Each material cylinder includes a material piston which is driven back and forth in a stroke cycle along a central axis of the material cylinder. During a fill stroke, the drive piston suctions material into the material cylinder. The material is expelled from the material cylinder to the outlet by a discharge or pumping stroke of the drive piston. The outlet is attached to the material disposal system. Typically, the material disposal system includes a lengthy outlet pipeline which terminates at a disposal device, such as an incinerator or containment pond. Alternatively, the material disposal system could include a truck which transports the pumped material to a remote area where it is spread out over the ground, subjected to further processing, etc.

Positive displacement viscous material pumps offer a number of significant advantages over alternative viscous materials handling systems, including screw or belt conveyers. Pumping viscous material through a pipeline contains odors for a safe and secure working environment. Viscous material pumps are capable of pumping thick, heavy sludges which may not be practical for belt or screw conveyers to transport. A pump and pipeline take up less space than a conveyer, and are capable of transporting material around corners with simple elbows. Viscous material pumps also offer reduction in noise over mechanical conveyers, and generally offer greater cleanliness and no spillage.

Multiple positive displacement viscous material pumps may be necessary for large volume applications such as pumping mine tailings. However, simultaneous discharge by all the pumps into the outlet pipeline can have substantial negative effects including massive pressure spikes within the outlet pipeline. The pressure spikes can lead to viscous material backing up into the pumps, or in extreme cases, pipeline or pump failure. Additionally, the physical arrangement and operation of multiple viscous material pumps can negatively affect the fill efficiency of some or all of the pumps due to variations in the amount of viscous material entering the cylinders of each pump. Poor pump fill efficiency is known to lead to cavitation during the pump's discharge stroke, thus increasing pump wear.

SUMMARY

A pump system for pumping a viscous material that includes N positive displacement pumps, where N is an integer greater than two, and a hydraulic drive. Each pump has an inlet and an outlet therefrom, and a pair of cylinders each with a piston movable in a reciprocating stroke cycle therein. The hydraulic drive is connected to the N positive displacement pumps to reciprocate the pistons within the cylinders. The stroke cycle includes a discharging stroke and a filling stroke. The discharging stroke and the filling stroke of the N positive displacement pumps are staggered from one another by 1/N stroke positions such that no two pumps have pistons in the same stroke position at the same time.

In another aspect, a method of monitoring the operation of a positive displacement pump assembly, the method includes providing the pump assembly with at least three positive displacement pumps, each positive displacement pump has a pair of cylinders each with a piston movable in a reciprocating stroke cycle therein. The stroke cycle includes a discharging stroke and a filling stroke. The reciprocating stroke cycle of the pistons are synchronized such that each piston is staggered out of phase from every other piston by a reciprocal (1/N, where N equals the total number of pistons) of the total number of pistons in the pump system. A fill efficiency of each cylinder is sensed based upon when a partially compressible viscous material, which contains solids, liquids, and gases begins to flow out of each cylinder during the discharging stroke of each piston after piston movement begins. An output value of each pump is determined based on the sensed fill efficiency of each cylinder pair. An output signal is generated as a function of the output value, and the speed of the reciprocating stroke cycle of all the pistons in the pump assembly or the reciprocating operation of one or more of the pistons in the pump assembly is changed to increase the fill efficiency of each cylinder in response to the output signal.

DETAILED DESCRIPTION

Figure 1A:
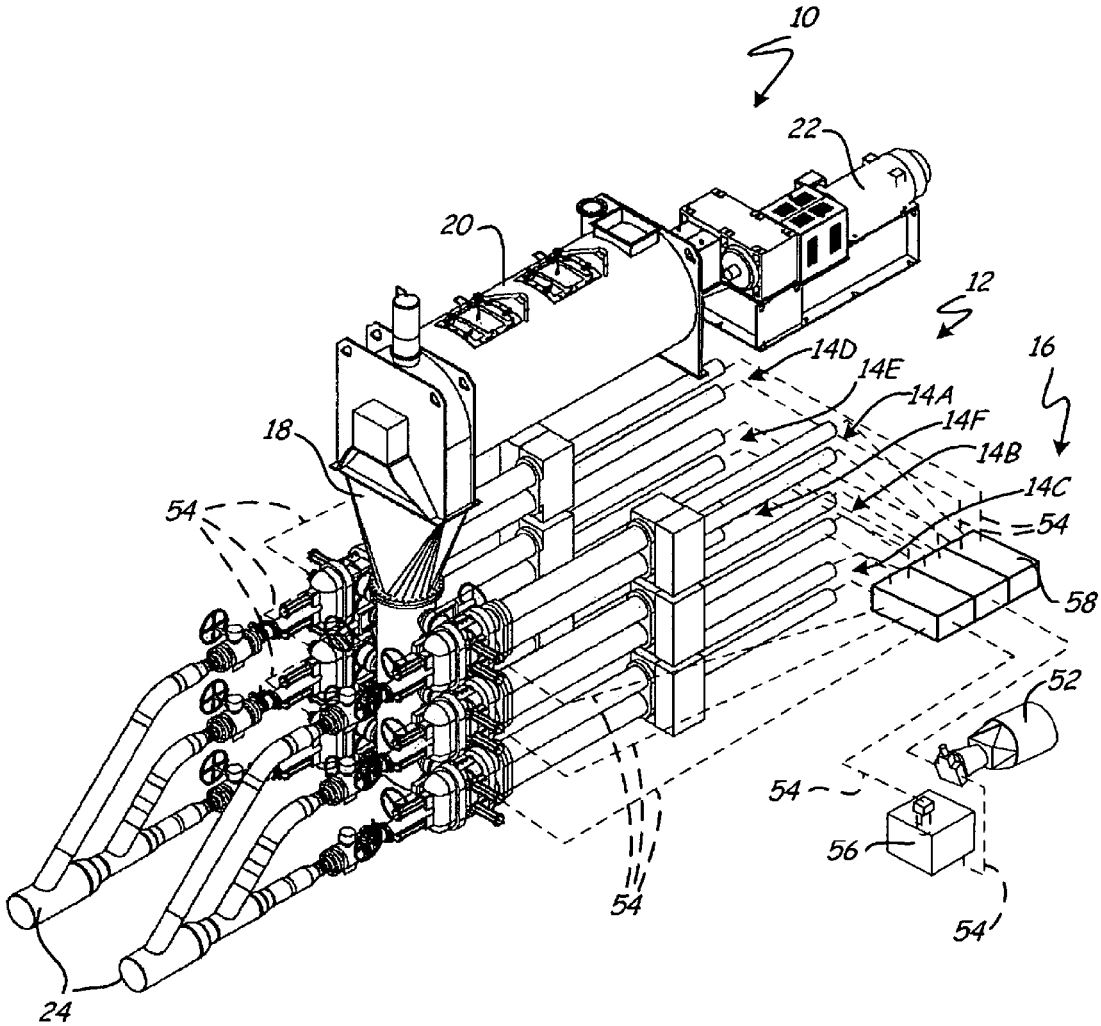
FIG. 1A is a perspective view of one embodiment of a viscous material pump system including multiple positive displacement pumps, a hydraulic drive assembly, a feeder, a hopper, and an outlet pipeline.
Figure 1B:
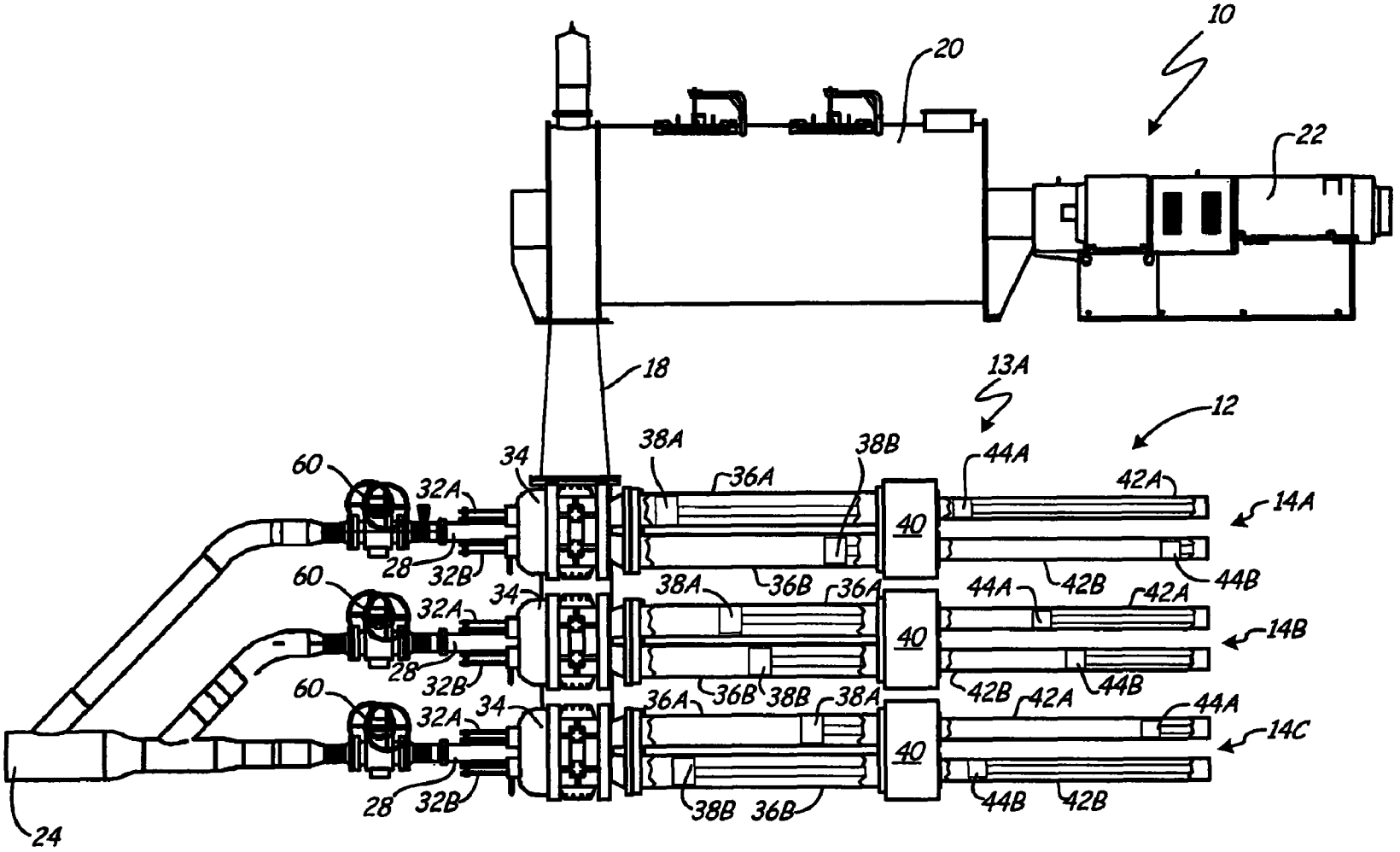
FIG. 1B is a side view of the viscous material pump system of FIG. 1A with the hydraulic drive assembly removed and portions of a pair of cylinders partially broken away to reveal pistons.
Figure 1C:
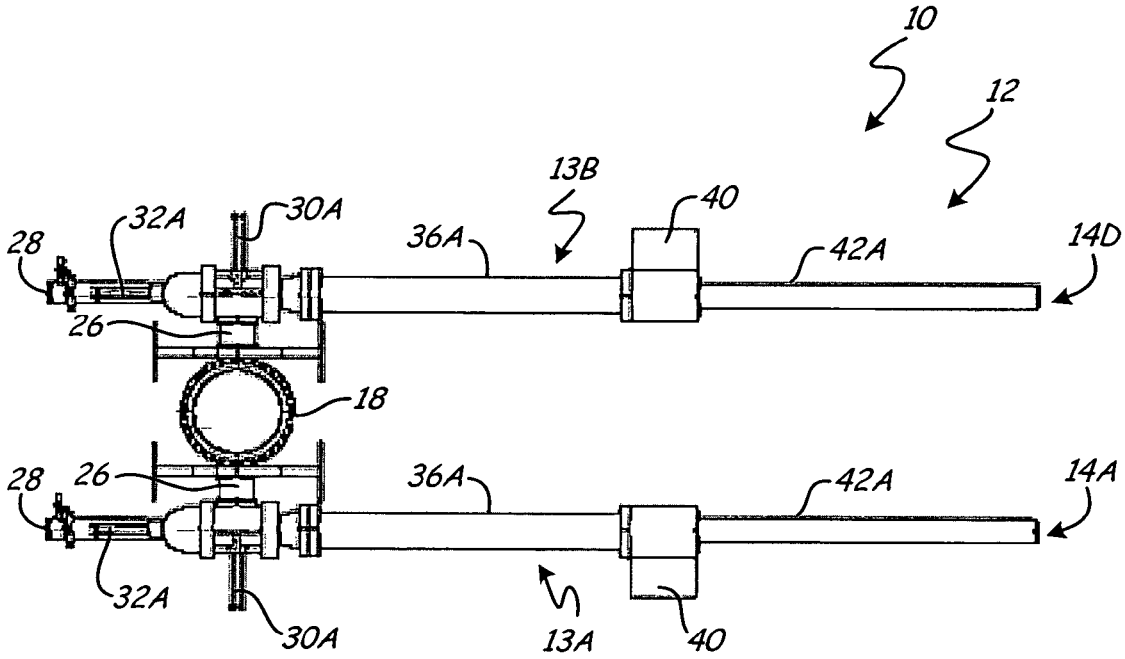
FIG. 1C is a top view of the viscous material pump system of FIG. 1A with the hydraulic drive assembly, feeder, and outlet pipeline removed.
Figure 1D:
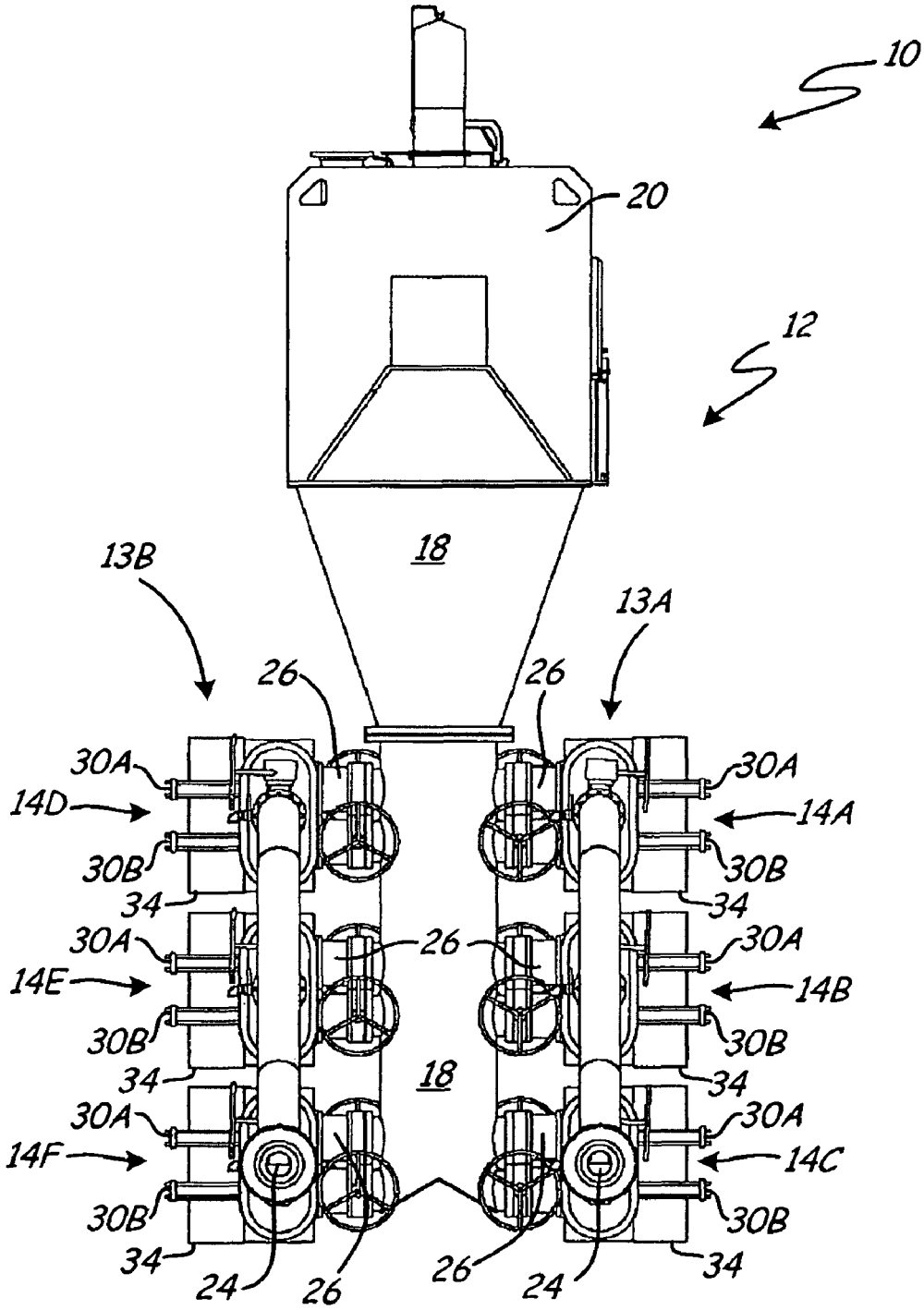
FIG. 1D is an end view of the viscous material pump system of FIG. 1A with the hydraulic drive assembly removed.

FIGS. 1A-1D show one embodiment of a viscous material pump system 10 from various perspectives. The viscous material pump system 10 includes a pump assembly 12 comprised of two generally vertical stacks 13A and 13B having multiple positive displacement pumps 14A, 14B, 14C, 14D, 14E, and 14F. The viscous material pump system 10 also includes a hydraulic drive assembly 16, a hopper 18, a feeder 20, a feeder motor 22, and an outlet pipeline 24. Each positive displacement pump 14A, 14B, 14C, 14D, 14E, and 14F includes an inlet 26, an outlet 28, inlet poppet valves 30A and 30B, outlet poppet valves 32A and 32B, a poppet valve housing 34, material cylinders 36A and 36B, material pistons 38A and 38B, a waterbox 40, hydraulic drive cylinders 42A and 42B, and drive pistons 44A and 44B. The hydraulic drive assembly 16 includes a hydraulic pump 52, pressure lines 54, a hydraulic reservoir 56, and a valve assembly 58. The outlet pipeline 24 includes ball valves 60 which allow each positive displacement pump 14A, 14B, 14C, 14D, 14E, and 14F to be isolated from the outlet pipeline 24. The ball valves 60 keep viscous material from backing up into the positive displacement pump 14A, 14B, 14C, 14D, 14E, or 14F in the event it is taken down, for example, for service. Although a single hydraulic drive assembly 16 is shown, the hydraulic drive assembly alternatively can be composed of several hydraulic drives, each of the several hydraulic drives being connected to one of the positive displacement pumps 14A, 14B, 14C, 14D, 14E, and 14F. While the exemplary embodiment specifically describes the configuration and orientation of piston pumps, other pump technologies such as progressive cavity, rotary lobe, centrifugal, and others may be arranged in a similar manner and use the inventive techniques/technology described herein. While the suction and discharge locations of these other pump technologies varies slightly (for instance with poppet valves disposed in the outlet and/or inlet lines) from that of piston pumps, those skilled in the art and application of pump systems would recognize and apply the inventive techniques/technologies described herein to the other pump technologies.

The positive displacement pumps 14A, 14B, 14C, 14D, 14E, and 14F of the pump assembly 12 are arranged in two stacks 13A and 13B. In the first stack 13A, the positive displacement pumps 14A, 14B, and 14C are oriented generally vertically along a common plane. Similarly, in the second stack 13B, positive displacement pumps 14D, 14E, and 14F are oriented generally vertically along a common plane. The dual stack arrangement 13A and 13B allows positive displacement pump 14A of the first stack 13A to be oriented generally horizontally along a common plane from positive displacement pump 14D of the second stack 13B. Likewise, positive displacement pump 14B is oriented generally horizontally along a common plane from positive displacement pump 14E and positive displacement pump 14C is oriented generally horizontally along a common plane from positive displacement pump 14F.

The hydraulic drive assembly 16, hopper 18, feeder 20, feeder motor 22, and outlet pipeline 24 are disposed adjacent the pump assembly 12. The hydraulic drive assembly 16, hopper 18 and outlet pipeline 24 connect to the pump assembly 12, while the feeder motor 22 connects to the feeder 20 which connects to the hopper 18. The hopper 18 extends generally vertically between the stacks 13A and 13B to connect to the positive displacement pumps 14A, 14B, 14C, 14D, 14E, and 14F via the inlets 26. Similarly, the output pipeline 24 connects to the positive displacement pumps 14A, 14B, 14C, 14D, 14E, and 14F via outlets 28.

The inlet poppet valves 30A and 30B and the outlet poppet valves 32A and 32B are disposed in the poppet valve housing 34 of each positive displacement pump 14A, 14B, 14C, 14D, 14E, and 14F. Inlet poppet valve 30A selectively connects material cylinder 36A to the inlet 26. Similarly, inlet poppet valve 30B selectively connects material cylinder 36B to the inlet 26. Outlet poppet valve 32A selectively connects material cylinder 36A to the outlet 28. Outlet poppet valve 32B selectively connects material cylinder 36B to the outlet 28.

Material cylinder 36A houses material piston 38A which is movable in a reciprocating stroke cycle therein. Likewise, material cylinder 36B houses material piston 38B which is movable in a reciprocating stroke cycle therein. The material cylinder 36A is connected to the waterbox 40 which is connected to hydraulic drive cylinder 42A. The material cylinder 36B is connected to the waterbox 40 which is connected to the hydraulic drive cylinder 42B. The material piston 38A is coupled through the waterbox 40 to the drive piston 44A. The material piston 38B is coupled through the waterbox 40 to the drive piston 44B.

Hydraulic drive cylinder 42A houses drive piston 44A that is movable in a reciprocating stroke cycle to drive the stroke cycle of material piston 38A. Both pistons 38A and 44A travel in the same direction during substantially the same period of time. Hydraulic drive cylinder 42B houses drive piston 44B that is movable in a reciprocating stroke cycle to drive the stroke cycle of material piston 38B. Both pistons 38B and 44B travel in the same direction during substantially the same period of time. The hydraulic drive cylinders 42A and 42B are fluidly connected to the hydraulic drive assembly 16. More specifically, pressure lines 54 connect the hydraulic pump 52 and hydraulic reservoir 56 to the hydraulic drive cylinders 42A and 42B and the poppet valve housing 34 through the valve assembly 58.

The feeder motor 22 drives a screw or similar mechanical delivery means within the feeder 20, which creates a pressure differential to move the viscous material to the hopper 18. The viscous material moves through the hopper 18 to the inlet 26 for each positive displacement pump 14A, 14B, 14C, 14D, 14E, and 14F.

The inlet poppet valves 30A and 30B control the flow of viscous material from the inlet 26 to the corresponding material cylinder 36A and 36B. The flow of viscous material from the material cylinders 36A and 36B to the outlet 28 is controlled by the outlet poppet valves 32A and 32B, respectively. The inlet poppet valves 30A and 30B and outlet poppet valves 32A and 32B can be hydraulically actuated or assisted depending upon whether a sludge flow measuring system (discussed subsequently) is employed with the pump system 10.

The stroke cycle of each material piston 38A and 38B within the corresponding cylinder 36A and 36B is comprised of a filling stroke, in which viscous material enters the cylinders 36A and 36B through movement of the inlet poppet valves 30A and 30B away from blocking the cylinders 36A and 36B communication with the inlet 26, and a discharge or pumping stroke, in which viscous material exits the cylinders 36A and 36B through movement of the outlet poppet valves 32A and 32B away from blocking the outlet 28. More specifically, because the stroke cycle of the material piston 38A is substantially 180° out of phase from the stroke cycle of the material piston 38B, the material piston 38A operates in a filling stroke when the material piston 38B operates in a discharge stroke and vice versa. Thus, as the drive pistons 44A and 44B and their coupled material pistons 38A and 38B come to the end of a stroke, one of the material cylinders 38A or 38B is discharging material to outlet 28, while the other material cylinder 38A or 38B is loading material from inlet 26.

The material pistons 38A and 38B are coupled to hydraulic drive pistons 44A and 44B, respectively. Hydraulic fluid is pumped from the hydraulic pump 52 through the pressure lines 54 to the valve assembly 58. The valve assembly 58 includes throttle and check valves which control the sequencing of high and low pressure hydraulic fluid to hydraulic drive cylinders 42A and 42B and to the poppet valve cylinders (not shown). Low pressure hydraulic fluid returns to hydraulic reservoir 56 through a low pressure portion of the pressure line 54 from valve assembly 58.

Forward and rear switching valves or sensors sense the position of the drive piston 44A at the forward and rear ends of travel and are interconnected to control valve assembly 56. Each time piston 44A reaches the forward or rear end of its travel in drive cylinder 42A, a valve sequence is initiated which results in reversing of all four poppet valves and a reversal of the high pressure and low pressure connections to drive cylinders 42A and 42B.

A sequence of operation comprising a stroke cycle for a single positive displacement pump 14A, 14B, 14C, 14D, 14E, or 14F utilizing sludge flow measurement technology is as follows. At the end of the discharging stroke, one material piston (for example piston 38A) is at its closest point to poppet valve housing 42, while the other material piston 38B is at its position furthest from poppet valve housing 42. At this point, the sensor or switching valve senses that the corresponding hydraulic drive piston 44A has reached the forward end of its stroke. The valve assembly 58 is activated which assists the inlet poppet valve 30A and the outlet poppet valve 32B in closing.

At this point, the material pistons 38A and 38B are at the ends of their stroke, and their direction of movement is about to reverse. All four poppet valves 30A, 30B, 32A, and 32B are closed. The hydraulic pressure begins to increase in the drive cylinder 42A, which drives the material piston 38A forward toward the poppet valve housing 34. The material piston 38A, therefore, is now in the discharging stroke. At the same time, hydraulic fluid located forward of the drive piston 44A is being transferred from the drive cylinder 42A through an interconnection line to the forward end of drive cylinder 42B. This applies hydraulic pressure to the drive piston 44B, which moves in a rearward direction in response. As a result, the material piston 38B begins moving away from the poppet valve housing 34 and is in the filling stroke. When the pressure in the poppet valve housing 36 below the inlet poppet valve 30B essentially equals the pressure on the inlet side, the poppet valve 30B opens, which allows sludge to flow through the inlet 26 and into the material cylinder 36B during the filling stroke.

As the material piston 38A begins to move forward, it initially compresses the viscous material within the material cylinder 36A. At the moment when the compressed viscous material equals the pressure of the compressed viscous material in the output pipeline 24 and at outlet 28, the outlet poppet valve 32A opens. Since the outlet poppet valve for the discharging material cylinder opens only when the material cylinder content pressure essentially equals the pressure in the pipeline 24, no material can flow back into the material cylinder.

As the operation of the positive displacement pump 14A, 14B, 14C, 14D, 14E, or 14F continues, the material piston 38A moves forward and material piston 38B moves rearward until the pistons again reach the end of their respective strokes. At that point, the switching valve causes the valve assembly 58 to close all four poppet valves and reverse the connection of the high and low pressure fluid to drive cylinders 42A and 42B.

Figure 2:
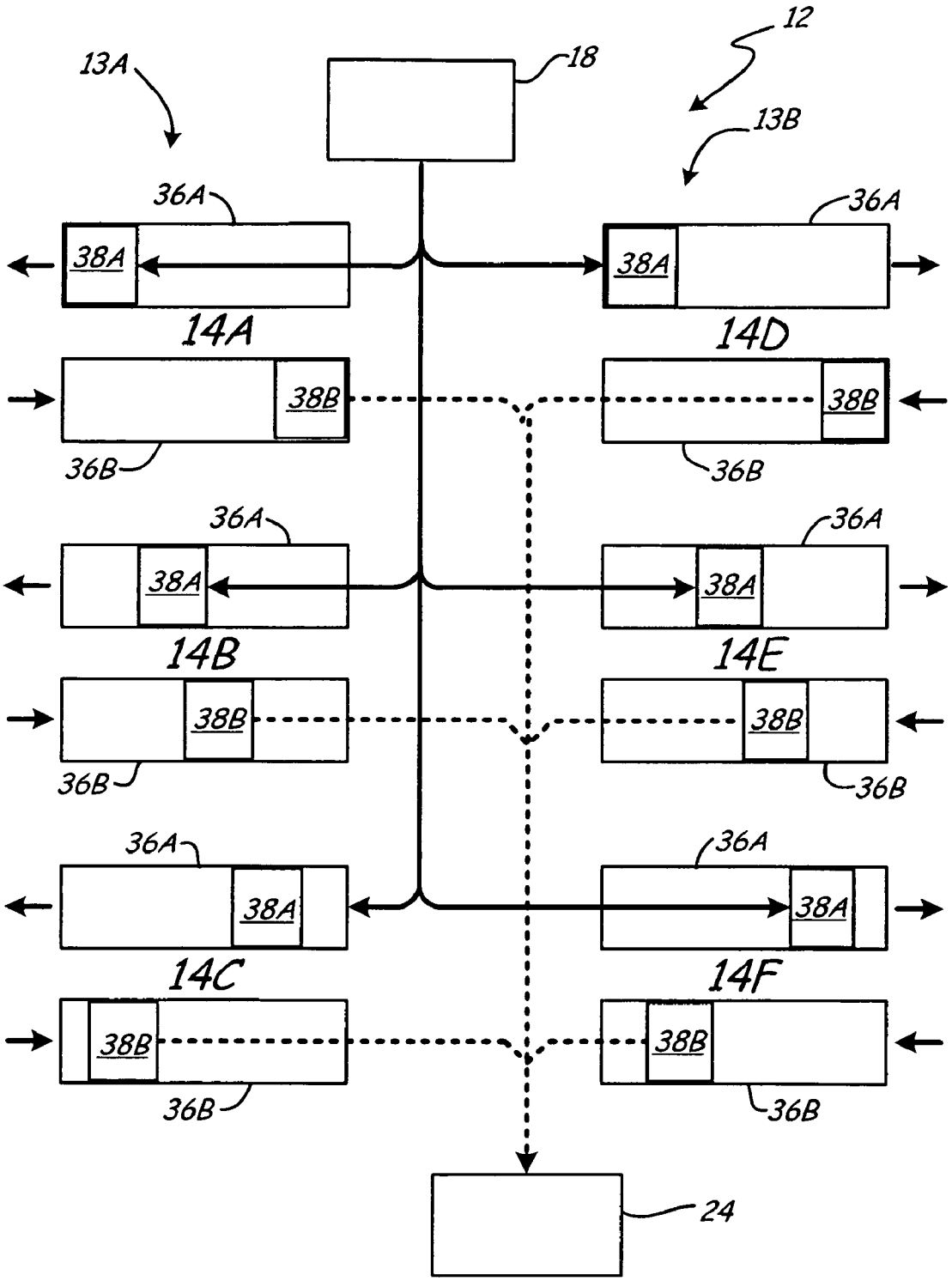
FIG. 2 is a schematic view of an exemplary arrangement of the multiple positive displacement pumps showing the disposition of pistons within the cylinders.

FIG. 2 shows an exemplary arrangement of the positive displacement pumps 14A, 14B, 14C, 14D, 14E, and 14F and the disposition of the material pistons 38A and 38B within the material cylinders 36A and 36B. Arrows 62 indicate the direction of movement of the material pistons 38A and 38B within the material cylinders 36A and 36B. Extended flow arrow 64 indicates a viscous material flowing into the material cylinders 36A of positive displacement pumps 14A, 14B, 14C, 14D, 14E, and 14F from the hopper 18 during the filling stroke of pistons 38A. Extended flow arrow 66 indicates the compressed viscous material flowing out of the material cylinders 36B of positive displacement pumps 14A, 14B, 14C, 14D, 14E, and 14F to the outlet pipeline 24 during the discharging stroke of pistons 38B.

As discussed previously, each positive displacement pump 14A, 14B, 14C, 14D, 14E, and 14F has two material cylinders 36A and 36B housing material pistons 38A and 38B. The material pistons 38A and 38 are movable within the material cylinders 36A and 36B in a reciprocating stroke cycle. Substantially half the stroke cycle of each material piston 38A and 38B is comprised of the filling stroke and the other half of the stroke cycle of each material piston 38A and 38B is comprised of the discharging stroke. Each positive displacement pump 14A, 14B, 14C, 14D, 14E, and 14F is arranged and operates such that the stroke cycle of material piston 38A is substantially 180° out of phase from the stroke cycle of the material piston 38B. Thus, when the material piston 38A is operating in a filling stroke the material piston 38B is operating in a discharging stroke and vice versa.

The stroke cycle of the material pistons 38A and 38B for each positive displacement pump 14A, 14B, 14C, 14D, 14E, and 14F can be staggered in phase with respect to one another in a pattern such as the one shown in FIG. 2. Thus, each positive displacement pump 14A, 14B, 14C, 14D, 14E, and 14F has a stroke cycle that is out of phase with the stroke cycle of every other positive displacement pump 14A, 14B, 14C, 14D, 14E, and 14F. More specifically, in the pump assembly 12 with N pumps, where N is an integer greater than two, both the discharging strokes and filling strokes of the positive displacement pumps are staggered by 1/N stroke increments or stroke positions from the discharging strokes and filling strokes of every other pump in the pump assembly. Therefore, no two pumps have material pistons 38A and 38B in the same stroke position at the same point in time. Thus, the outlet poppet valve 32A or 32B of positive displacement pump 14A, 14B, 14C, 14D, 14E, or 14F opens to allow viscous material to flow to the outlet 28 at a different point in time for each positive displacement pump 14A, 14B, 14C, 14D, 14E, and 14F, and the outlet poppet valves 32A and 32B of positive displacement pumps 14A, 14B, 14C, 14D, 14E, and 14F can be synchronized to open to the outlet 28 at substantially equally spaced time increments. Similarly, the inlet poppet valve 30A or 30B of the positive displacement pump 14A, 14B, 14C, 14D, 14E, or 14F opens to allow viscous material to flow from the inlet 26 to the material cylinders 36A or 36B at a different point in time for each positive displacement pump 14A, 14B, 14C, 14D, 14E, and 14F, and the inlet poppet valves 30A and 30B of positive displacement pumps 14A, 14B, 14C, 14D, 14E, and 14F can be synchronized to open to the material cylinders 36A and 36B at substantially equally spaced time increments.

In this manner, simultaneous initial discharge by all the pumps (whatever their number) in the pump assembly 12 into the outlet pipeline can be avoided. Thus, pressure spikes within the outlet pipeline due to simultaneous initial discharge are reduced. The instances of viscous material backing up into the pumps due to the pressure spikes are also reduced.

Figure 3:
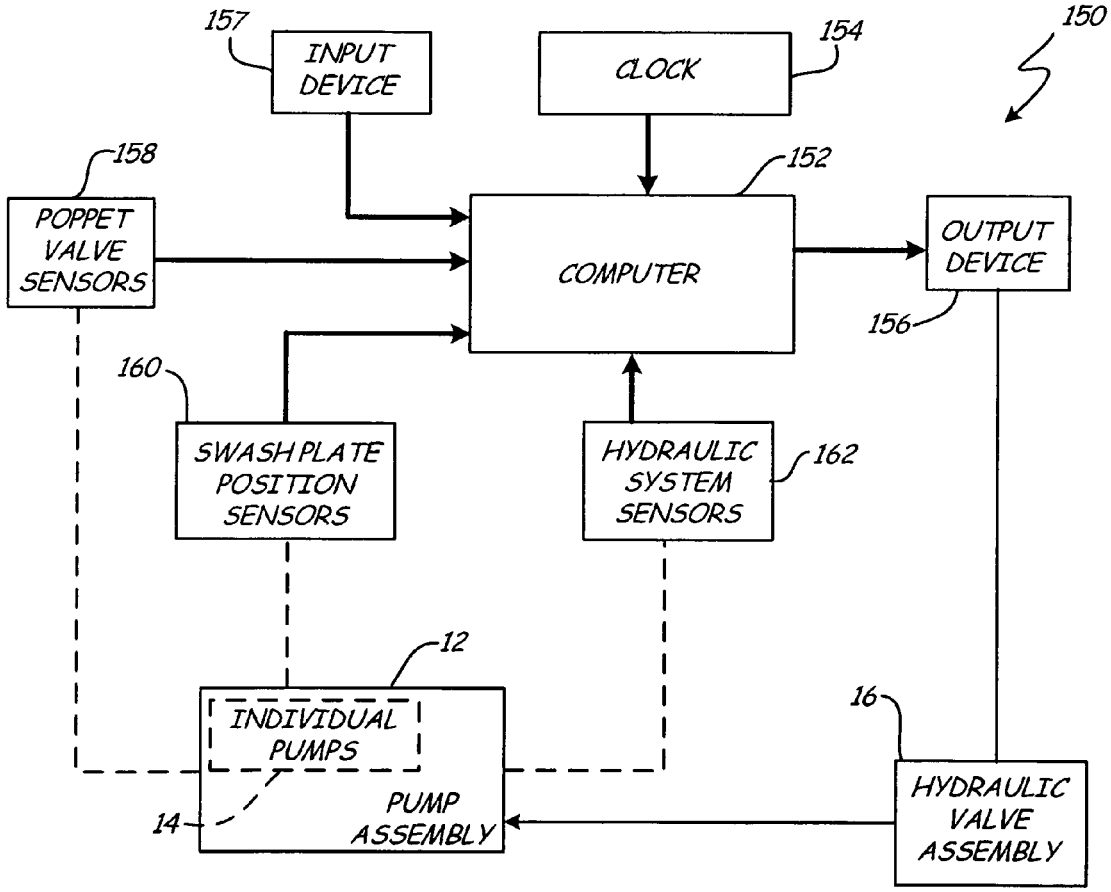
FIGS. 3-4 are block diagrams of alternative monitoring systems for determining instantaneous and accumulated volumes of viscous materials pumped by the multiple positive displacement pumps.
Figure 4:
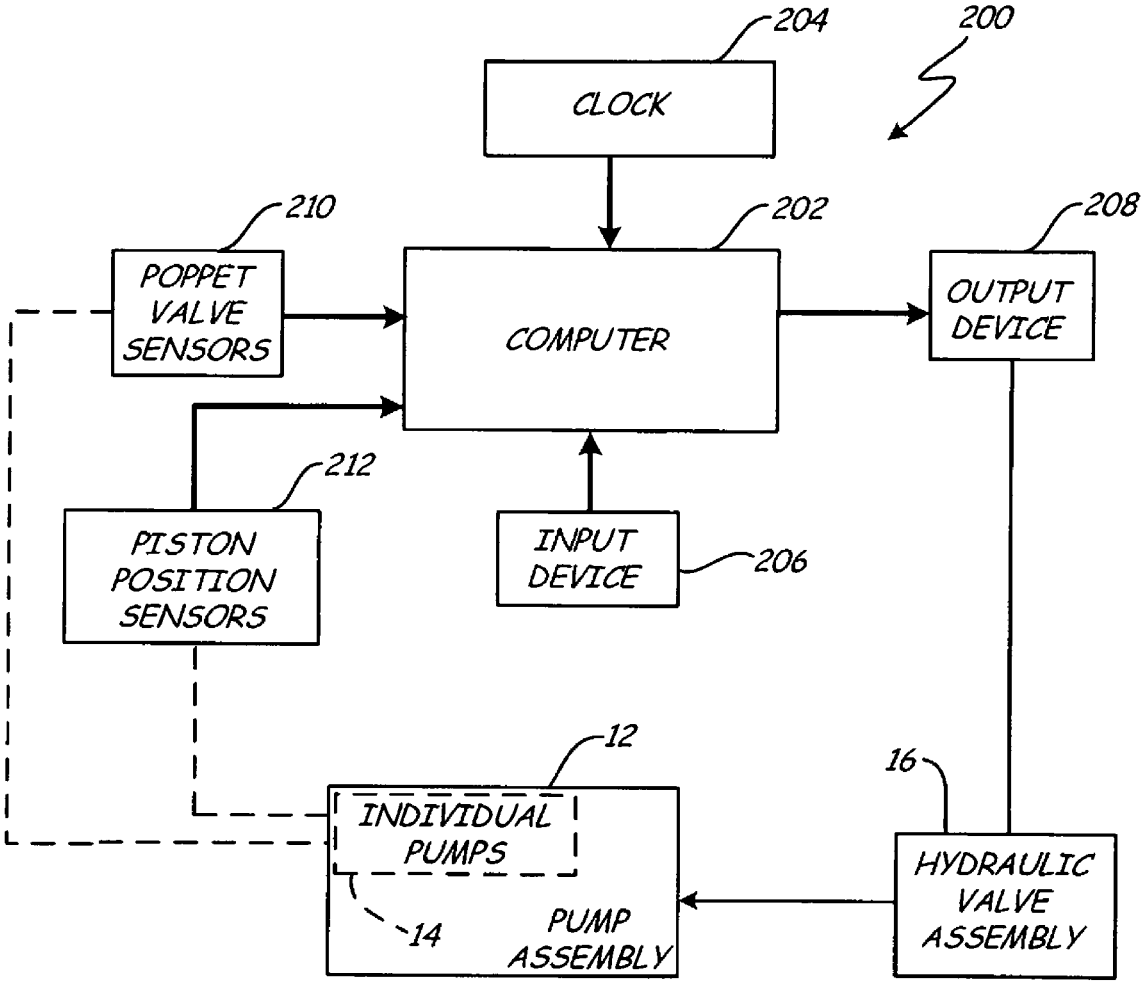

FIGS. 3 and 4 show block diagrams of alternative monitoring systems for determining instantaneous and accumulated volumes of viscous materials pumped by the pump assembly 12. Each monitoring system allows the fill efficiency of each material cylinder (and each positive displacement pump 14) in the pump assembly 12 to be sensed based upon when the partially compressible viscous material (which contains solids, liquids, and gases) begins to flow out of each material cylinder. A computer determines an output value of each positive displacement pump 14A, 14B, 14C, 14D, 14E, and 14F based on the sensed fill efficiency of each cylinder pair and generates an output signal as a function of the output value. The output signal is transmitted to the hydraulic drive, which in response, changes the speed of the reciprocating stroke cycle of all the pistons in the pump assembly 12 or ceases driving reciprocation of one or more pumps or cylinders to increase the fill efficiency of each cylinder. Based on the calculated output value the computer can also generate an output signal and send that signal to vary the speed of the feeder motor 22 and hence the feeder 20 (FIGS. 1A-1D). As fill efficiency of the pump assembly 12 is a function of material fill in the hopper 18, the speed of the feeder motor 22 and feeder 20 can be adjusted (with or without changing the speed of the reciprocating stroke cycle of all the pistons) to optimize the fill efficiency of the pump assembly 12.

Additionally, the computer can compare the fill efficiency of one or more positive displacement pumps 14A, 14B, or 14C in the first stack 13A to the fill efficiency of the at least one positive displacement pump in the second stack 13B (FIG. 1). A fault condition can be triggered and transmitted to the operator or the hydraulic drive (which in response could halt operation of the pumps being compared) if the compared fill efficiencies vary by more than a predetermined error value. In one embodiment, this error values is a 10 percent difference in fill efficiency between the pumps being compared.

In addition to monitoring the instantaneous and accumulated volumes of viscous materials to help meet various state and federal regulations required for some pumping applications, the monitoring system disclosed can be used as a diagnostic tool to monitor fill efficiency so that preventative maintenance can be scheduled to avoid unplanned pump shutdowns. Additionally, the monitoring system can control the speed at which the pump assembly operates (or can shut off one or more pumps or cylinders) so that one or more pumps do not run near empty (i.e. with low fill efficiency). Thus, excessive pump wear and premature pump failure due to the cavitation that occurs at low pump fill efficiency can be avoided and the service life of the pumps increased.

In particular, the total time T for the discharge stroke of the stroke cycle includes three time components. Time T1 is the time from the end of movement of the piston until the piston starts moving again. Time T2 is the time from the beginning of movement of the piston until pressure has built to a point where the pressure of the viscous material overcomes the outlet pressure so that the flow of material will be out of the material cylinder 36A or 36B to the outlet 28. Time T3 is the time during which the material is being pumped out of the material cylinder 36A or 36B to the outlet 28.

By comparing times T2 and T3, it is possible to determine a fill efficiency (or a percentage fill) of material in a material cylinder during a particular discharge stroke of the stoke cycle. The fill efficiency is: (T3−T2)/(T3−T1). This assumes that the material piston is moving at an essentially constant velocity. By knowing the fill efficiency during one discharge stoke and the total displacement volume of the cylinder, the volume pumped during a particular discharge stroke can be determined. By adding together the pumped volumes for multiple stroke cycles, an accumulated volume can be determined. The total volume pumped by the pump assembly 12 is determined by summing of the accumulated volume for each pump in the assembly 12. Similarly, by dividing the accumulated volume by the time period over which that the volume has been accumulated, an average pumping rate can be determined. An instantaneous pumping rate for each discharge stroke can also be determined. By knowing the total time T of the discharge stroke, the fill efficiency, and the total volume when the cylinder is 100 percent filled, the instantaneous pumping rate for each individual cylinder and each positive displacement pump 14A, 14B, 14C, 14D, 14E, or 14F can be determined. The total instantaneous pumping rate of the pumping assembly 12 can be determined by summing the instantaneous rates for each positive displacement pump in the system 10 and dividing by the number of positive displacement pumps in the system 10.

Utilizing the closed loop feedback circuits shown in FIGS. 3 and 4, the hydraulic drive assembly 16 is controlled to either increase/decrease the reciprocating speed of the pistons within the positive displacement pumps 14A, 14B, 14C, 14D, 14E, and 14F FIG. 3 shows a first embodiment of the monitoring and controlling system 150, in which operation of the pump assembly 12 and the multiple individual positive displacement pumps 14 are monitored to provide an accurate measurement of volume pumped on a cycle-by-cycle basis, and on an accumulated basis. The system 150 also provides a means for controlling the pumping of the positive displacement pumps 14A, 14B, 14C, 14D, 14E, and 14F (or each cylinder of each pump 14A, 14B, 14C, 14D, 14E, and 14F) based on the sensed fill efficiency of each cylinder pair. More specifically, the sensed fill efficiency of each positive displacement pump 14A, 14B, 14C, 14D, 14E, and 14F is converted to an output value and then an output signal by certain components disclosed in FIG. 3. The output signal is transmitted to the hydraulic drive 16, which in response, changes the speed of the reciprocating stroke cycle of all the pistons in the pump assembly 12 or ceases driving reciprocation of one or more pumps or cylinders to increase the fill efficiency of each cylinder.

For these purposes, the monitoring and controlling system 150 includes a digital computer 152, which in one embodiment is a microprocessor based computer including an associated memory and input/output circuitry, a clock 154, an output device 156, an input device 157, poppet valve sensors 158, swash plate position sensors 160, and hydraulic system sensors 162.

The clock 154 provides a time base for the computer 152. Although shown separately in FIG. 4, the clock 154 can be part of the digital computer 152. The output device 156 can also be part of the computer 152 or it can be a stand alone unit. In either case, output values representing the fill efficiency of each cylinder are converted to output signals (control signals) by the computer 152 and then are transmitted by the output device 156 to the hydraulic drive assembly 16. The output device 156 can also include a monitoring/communication device, for example, a cathode ray tube or a liquid crystal display, a printer, which transmits the output of the computer 152 to another computer based system (which may, for example, be monitoring the overall operation of the entire facility where pump assembly 12 is being used).

The sensors 158, 160 and 162 monitor the operation of the pump assembly 12 and the individual positive displacement pumps 14 and provide signals to the computer 152. The parameters sensed by the sensors 158, 160, 162, provide an indication of the fill efficiency of the cylinders during each discharging stroke of each positive displacement pump 14, and allow the computer 152 to determine the time period of the stoke cycle. From this information, the computer 152 determines the volume of material pumped during that particular stroke cycle, the accumulated volume, the pumping rate during that stroke cycle, and an average pumping rate over a selected period of time. These determined values represent output values. The computer 152 stores the data in memory, and also provides output signals to the output device 156 (or as discussed hydraulic drive assembly 16 if the output device 156 is incorporated by the computer 152) based upon the particular information selected by input device 157.

One determination of volume pumped during a discharging stoke is as follows: The hydraulic system sensors 162 provide an indication to the computer 152 of the start of the discharging stroke of each positive displacement pump 14 in the pump assembly 12. The sensors 162 also provide an indication of the time at which the discharging stroke ends. These signals are supplied to the computer 152 by the sensors 162, preferably in the form of interrupt signals.

The poppet valve sensors 158 sense when the outlet poppet valve of each cylinder opens during the discharging stroke. The signal from poppet valve sensors 158 can be in the form of an interrupt signal to the computer 152. The swash plate position sensors 160 sense the flow rate of the hydraulic fluid from the hydraulic pump 52. The swash plate position determines the flow rate, and the output of position sensors 162 is can be a digital signal to the computer 152 which can be converted to a flow rate.

Based upon the signals from the sensors 158, 160 and 162, the computer 152 knows the beginning of each discharging stroke, the point in time when the associated outlet poppet valve opens, and the end of the discharging stroke. By using the clock signals from the clock 154, the computer 152 is able to determine times T2 and T3. As long as the pumping rate is not changed by the operator in the middle of a discharging stroke, the ratio of (T3−T2)/(T3−T1) will provide an accurate representation of the fill efficiency during the discharging stroke. Swash plate position sensors 160 are intended to indicate to the computer 152 that the velocity has indeed remained essentially constant through the discharging stoke. Otherwise, adjustments must be made, because the ratio to determine fill efficiency is actually the ratio of the length of the discharging stroke with the material fully compressed to the total length of the discharging stroke. The use of times T2 and T3 instead of distance of travel of the piston is based on the assumption that each piston is moving at an essentially constant rate.

In the embodiment shown, the computer 152 calculates, for each discharging stroke, the fill efficiency. Knowing the total displacement volume of each cylinder, the computer 152 calculates the actual volume pumped during each stroke cycle. That value represents an output value that is stored in a register within the memory of the computer 152. In addition, the computer 152 updates a register which keeps an accumulated total of the volume pumped. Because the computer 152 also determines the length of time during each discharging stroke and the accumulated time over which the accumulated volume has been pumped, it is possible to calculate an instantaneous pumping rate for each stroke cycle, as well as an average pumping rate over the accumulated time. All four values (the volume pumped in a particular stroke cycle, the total accumulated volume, the instantaneous pumping rate, and the average pumping rate) represent output values that are converted to output signals that are sent to the output device 156. Additionally, it is possible through summing the number of positive displacement pumps in the pump assembly 12 (and in the case of the instantaneous pumping rate and the average pumping rate, re-averaging) to determine all four values for the pump assembly 12 as a whole. Typically, the operator will select the particular information to be displayed or controlled for the entire assembly 12 or for a particular positive displacement pump 14 by toggling through modes in the input device 157, which then transmits any control signals the operator selects to the computer 152 and/or output device 156.

FIG. 4 shows another embodiment of the monitoring and controlling system 200 which monitors and controls the operation of pump assembly 12 and the multiple positive displacement pumps 14.

The system 200 controls operation of the pump assembly 12 in a manner similar to system 150 discussed in reference to FIG. 3. Thus, the system 150 provides a means for controlling the pumping of the positive displacement pumps 14A, 14B, 14C, 14D, 14E, and 14F (or each cylinder of each pump 14A, 14B, 14C, 14D, 14E, and 14F) based on the sensed fill efficiency of each cylinder pair. More specifically, the sensed fill efficiency of each positive displacement pump 14A, 14B, 14C, 14D, 14E, and 14F is converted to an output value and then an output signal by certain components disclosed in FIG. 3. The output signal is transmitted to the hydraulic drive 16, which in response, changes the speed of the reciprocating stroke cycle of all the pistons in the pump assembly 12 or ceases driving reciprocation of one or more pumps or cylinders to increase the fill efficiency of each cylinder.

In FIG. 4, the monitoring and controlling system 200 includes a computer 202, a clock 204, an input device 206, an output device 208, poppet valve sensors 210, and piston position sensors 212.

The piston position sensors 212 sense the position of both of the pistons of each of the multiple positive displacement pump 14 during their discharging strokes. From the signals supplied by the piston position sensors 212, the starting and stopping points of each discharging stroke are known. The piston position sensors 212 can be a linear displacement sensor (which may be an analog sensor) together with an analog-to-digital converter so that the data supplied to computer 202 is in digital form.

When the poppet valve opens, as indicated by the poppet valve sensors 212, the value being read by the piston position sensors 212 is supplied to the computer 202. The distance from the start of the discharging stroke to the opening of the valve is distance L1, and the distance from the opening of the poppet valve to the end of the stroke is distance L2. The fill efficiency is L2/(L1+L2).

The clock 204 provides a base time to the computer 202 so that the instantaneous and average pumping rate values can be calculated. As in system 150 shown in FIG. 3, in the system 200 the volume pumped during a particular pumping cycle, the accumulated volume pumped, the instantaneous pumping rate, and the average pumping rate are calculated by the computer 202 and represent output values which stored in appropriate registers of its memory. Likewise, all four output values can be determined for the pump assembly 12 as a whole by summing the number of positive displacement pumps in the pump assembly 12 (and in the case of the instantaneous pumping rate and the average pumping rate, re-averaging). Upon commands supplied by the input device 206 to the computer 202 and or output device 208, the output values (now converted to output signals) can be used to monitor or control performance of the system 200. The operator can select the particular information to be displayed or controlled for the entire assembly 12 or for a particular positive displacement pump 14 by toggling through modes in the input device 206, which then transmits any control signals the operator selects to the computer 202. Alternatively, the output device 208 can include a communication device (as well as having a control function) that sends the information to another computer of another system which is monitoring the operation of a facility in which the pump assembly 12 is being used.

Although the present invention has been described with reference to preferred embodiments, workers skilled in the art will recognize that changes may be made in form and detail without departing from the spirit and scope of the invention.

The invention claimed is:

1. A pump system for pumping a viscous material, the pump system comprising:

N positive displacement pumps, where N is an integer greater than two, each pump having an inlet and an outlet therefrom and having a first material housing cylinder with a first piston disposed therein and a second material housing cylinder with a second piston disposed therein, both pistons movable in a reciprocating stroke cycle that includes a discharging stroke and a filling stroke, wherein the first piston is arranged and operates substantially 180° out of phase from the second piston such that when the first piston is subject to the filling stroke the second piston is subject to the discharging stroke; and a hydraulic drive connected to the N positive displacement pumps to reciprocate each piston within each material housing cylinder so that the discharging strokes and the filling strokes of the N positive displacement pumps are staggered from one another by 1/N stroke positions such that no two pumps have pistons in the same filling stroke position or discharging stroke position at the same time.

2. The system of claim 1, wherein the hydraulic drive is comprised of N hydraulic drives each of the N hydraulic drives connected to one of the N positive displacement pumps.

3. The system of claim 1, wherein the N pumps in the pump system begin discharging through the outlets at different substantially equally spaced increments of time.

4. The system of claim 1, further comprising:

a sensor capable of sensing a fill efficiency of each material housing cylinder based upon when a partially compressible viscous material, which contains solids, liquids, and gases begins to flow out of each material housing cylinder during the discharging stroke of each piston after piston movement begins; and a computer that determines an output value of each pump based on the sensed fill efficiency of each pair of material housing cylinders and generates an output signal as a function of the output value;

wherein the output signal is transmitted to the hydraulic drive which in response changes the speed of the reciprocating stroke cycle of the N pistons in the pump assembly to increase the fill efficiency of each material housing cylinder.

5. The system of claim 1, further comprising an outlet poppet valve connecting each cylinder to the outlet of each of the N pumps during the discharging stroke and an inlet poppet valve connecting each material housing cylinder to the inlet of each of the N pumps during the filling stroke, and wherein each of the outlet poppet valves and the inlet poppet valves open at substantially equally spaced time increments.

6. The system of claim 1, wherein the pump system has six positive displacement pumps.

7. The system of claim 1, wherein the pump system includes a first stack of multiple pumps oriented generally vertically along a common plane and a second stack of multiple pumps oriented generally vertically along a common plane.

8. The system of claim 7, wherein the multiple pumps of the first stack are oriented generally horizontally along a common plane with the multiple pumps of the second stack and a computer compares the sensed fill efficiency of each pump of the first stack to the sensed fill efficiency of the corresponding horizontally commonly aligned pump of the second stack and determines if a fault condition has occurred based on a predetermined level of variance between the two fill efficiencies.

9. The system of claim 6, further comprising a hopper disposed between the first stack of pumps and the second stack of pumps and connected to the inlet of each of the N pumps.

10. A pump system for pumping a viscous material, the pump system comprising:

a first positive displacement pump having an inlet and an outlet therefrom and having a first material housing cylinder with a first piston disposed therein and a second material housing cylinder with a second piston disposed therein, both pistons movable in a reciprocating stroke cycle which includes a discharging stroke and a filling stroke, the stroke cycle of the first piston and second piston are staggered substantially 180° out of phase from one another such that when one of the pistons operates substantially in the discharging stroke the other piston operates substantially in the filling stroke;

a second positive displacement pump having an inlet and an outlet therefrom and having a third material housing cylinder with a third piston disposed therein and a fourth material housing cylinder with a fourth piston disposed therein, both pistons movable in the reciprocating stroke cycle which includes the discharging stroke and the filling stroke, the stroke cycle of the third piston is staggered out phase from the stroke cycle of the first piston such that neither the first or the third piston completes the discharging stroke or the filling stroke at the same time and the stroke cycle of the fourth piston is staggered out of phase from the stroke cycle of the second piston such that neither the second or the fourth piston completes the discharging stroke or filling stroke at the same time, wherein the stroke cycle of the third piston is staggered substantially 180° out phase from the stroke cycle of the fourth piston such that when one of the pistons operates substantially in the discharging stroke the other piston operates substantially in the filling stroke;

a third positive displacement pump having an inlet and an outlet therefrom and having a fifth material housing cylinder with a fifth piston disposed therein and a sixth material housing cylinder with a sixth piston disposed therein, both pistons movable in the reciprocating stroke cycle which includes the discharging stroke and the filling stroke, the stoke cycle of the fifth piston is staggered out of phase from the stroke cycle of the first and third pistons such that neither the first or the third piston completes the discharging stroke or filling stroke at the same time as the fifth piston and the stroke cycle of the sixth piston is staggered out of phase from the discharging stroke and filling stroke of the second and fourth pistons such that neither the second or the fourth piston completes the discharging stroke or filling stroke at the same time as the sixth piston, wherein the stroke cycle of the fifth piston is staggered substantially 180° out phase from the stroke cycle of the sixth piston such that when one of the pistons operates substantially in the discharging stroke the other piston operates substantially in the filling stroke;

a hydraulic drive connected to the first, second and third positive displacement pumps and adapted to reciprocate the pistons within the material housing cylinders such that stroke cycle of each piston is staggered out of phase from the reciprocating cycle of every other piston such that no two pistons have the same filling stroke position or discharging stroke position at the same time.

11. The system of claim 10 and further comprising:

outlet valves connecting the first, second, third, fourth, fifth, and sixth material housing cylinder to an outlet pipeline during a discharging portion of the stroke cycle of the first, second, third, fourth, fifth, and sixth piston and synchronized to open to the outlet pipeline at substantially equally spaced time increments;

inlet valves connecting the first, second, third, fourth, fifth, and sixth material housing cylinder to a viscous material feed device during a filling portion of the stroke cycle of the first, second, third, fourth, fifth, and sixth piston;

a sensor capable of sensing a fill efficiency of each material housing cylinder based upon when a partially compressible viscous material, which contains solids, liquids, and gases begins to flow out of each material housing cylinder during the discharging stroke of each piston after piston movement begins; and a computer that determines an output value of each pump based on the sensed fill efficiency of each positive displacement pump and generates an output signal as a function of the output value.

12. The system of claim 10, wherein the hydraulic drive is comprised of N hydraulic drives each of the N hydraulic drives connected to one of the N positive displacement pumps.

13. The system of claim 10, wherein the output signal is transmitted to the hydraulic drive to either change the speed of the reciprocating stroke cycle of all the pistons in the pump assembly or cease reciprocating operation of one or more of the pistons in the pump assembly thereby increasing the fill efficiency of each pump.

14. The system of claim 10, wherein all the pistons in the pump system are staggered from one another by 1/N stroke positions, where N equals the number of pistons in the pump system, such that no two pumps have pistons in the same stroke position at the same time.

15. The system of claim 14, wherein the inlet valves and outlet valves are synchronized to open at substantially equal time increments for each pair of material housing cylinders.

16. The system of claim 10, wherein the pump system has six positive displacement pumps.

17. The system of claim 11, wherein the pump system includes a first stack of multiple pumps oriented generally vertically along a common plane and a second stack of multiple pumps oriented generally vertically along a common plane.

18. The system of claim 17, wherein the multiple pumps of the first stack are oriented generally horizontally along a common plane with the multiple pumps of the second stack and the computer compares the sensed fill efficiency of each pump of the first stack to the sensed fill efficiency of the corresponding horizontally commonly aligned pump of the second stack and determines if a fault condition has occurred based on a predetermined level of variance between the two fill efficiencies.

19. A method of monitoring operation of a positive displacement pump assembly, the method comprising:

providing the pump assembly with at least three positive displacement pumps, each positive displacement pump having a pair of material housing cylinders each with a piston movable in a reciprocating stroke cycle therein, the stroke cycle includes a discharging stroke and a filling stroke;

synchronizing the reciprocating stroke cycles of the pistons such that each piston is staggered out of phase from every other piston by a reciprocal of the total number of pistons in the pump system, wherein each pair of pistons for each pump are arranged and operate substantially 180° out of phase from one another such that when a first of each pair of pistons is subject to the filling stroke a second of each pair of pistons is subject to the discharging stroke.

20. The method of claim 19 and further comprising:

sensing a fill efficiency of each material housing cylinder based upon when a partially compressible viscous material, which contains solids, liquids, and gases begins to flow out of each material housing cylinder during the discharging stroke of each piston after piston movement begins;

determining an output value of each pump based on the sensed fill efficiency of each material housing cylinder pair;

providing an output signal as a function of the output value; and changing either the speed of the reciprocating stroke cycle of all the pistons in the pump assembly or the reciprocating operation of one or more of the pistons in the pump assembly to increase the fill efficiency of each material housing cylinder in response to the output signal.

21. The method of claim 19, wherein all the pumps in the positive displacement pump assembly begin and complete the discharging stroke and filling stroke at a different time from one another.

22. The method of claim 20, wherein the output value represents a volume of sludge material delivered by the pump.

23. The method of claim 20, wherein the output value represents a flow rate of sludge material delivered by the pump.

24. The method of claim 20, wherein the positive displacement pump assembly includes a first stack of positive displacement pumps oriented generally vertically along a common plane and a second stack of positive displacement pumps oriented generally vertically along a common plane.

25. The method of claim 24, further comprising:

comparing the fill efficiency of the at least one positive displacement pump in the first stack to the fill efficiency of the at least one positive displacement pump in the second stack; and providing a fault condition if the compared fill efficiencies vary by more than a predetermined error value.

* * * * *